United States Patent [19]

Johnson

[11] Patent Number: 4,802,607

[45] Date of Patent: Feb. 7, 1989

[54] TIP TRIMMER ASSEMBLY FOR A CAULKING GUN

[76] Inventor: Raymond A. Johnson, P.O. Box, Carpinteria, Calif. 93013

[21] Appl. No.: 146,079

[22] Filed: Jan. 20, 1988

[51] Int. Cl.[4] ..... B67B 7/54

[52] U.S. Cl. ..... 222/82; 83/580; 222/83; 222/326; 222/391

[58] Field of Search ..... 222/80–83, 222/83.5, 153, 192, 325–327, 391; 30/92, 93, 95, 96, 112, 115, 289, 295; 7/129–132; 83/580

[56] References Cited

U.S. PATENT DOCUMENTS 1,176,638 3/1916 Arnold ..... 7/131 X 2,659,517 11/1953 Reinhardt, Jr. ..... 222/83.5 X

*Primary Examiner*—Kevin P. Shaver

*Attorney, Agent, or Firm*—Armstrong, Nikaido, Marmelstein & Kubovcik

[57] ABSTRACT

A nozzle tip trimmer adapted for use between a manually actuated caulking gun handle and trigger assembly having a shaped body with a curved contour along one edge and a pivot adjacent one end of the curved contour. A cutting edge is disposed along a second edge of the shaped body opposite from the curved contour and a detent is carried by the body for selective engagement with predetermined positions on the caulking gun handle. The shaped body is pivoted on a shaft remote from the trigger pivot and is preferably formed with a recess providing a curved finger engaging portion adjacent the end of the curved contour opposite from the pivot and adapted for moving the shaped body about the pivot to displace the detent from one position to an adjacent position on the caulking gun handle.

11 Claims, 3 Drawing Sheets

TIP TRIMMER ASSEMBLY FOR A CAULKING GUN

BACKGROUND OF THE INVENTION

The present invention is directed to a tip trimmer assembly for trimming the tip off of a nozzle of a caulking gun cartridge and, more specifically, to a tip trimmer assembly which is adapted for use between a manually actuated caulking gun handle and trigger assembly.

Caulking guns having an arrangement for trimming or cutting the tip of a cartridge nozzle are disclosed in U.S. Pat. Nos. 3,189,226 and 3,105,614. In each of these patents a blade having a projection is pivoted at the pivot point of the trigger and the trigger engages the protection projection to drive the cutting edge of the blade across at least one aperture in the handle. U.S. Pat. No. 4,135,644 discloses a caulking gun assembly in which a pair of cutting blades are integrally formed as part of a trigger of a caulking gun. U.S. Pat. No. 4,493,437 discloses a caulking gun having a tip trimmer assembly with a razor blade attached as a cutting element to a caulking gun trigger. U.S. Pat. No. 4,390,115 discloses a caulking gun trimming assembly in which the inside edges of a plurality of apertures are sharpened to provide shearing edges for trimming the tip of a caulking gun cartridge nozzle.

Each of the foregoing trimming assemblies rely on movement of the trigger relative to the handle to effect the desired trimming or shearing action and the shearing action is effected each time the trigger is squeezed regardless of whether a nozzle tip is being trimmed or not. Moreover, the trimming assemblies in each of the above-mentioned references must be provided at the time when the caulking gun is being manufactured and, with the exception of U.S. Pat. No. 4,390,115, the cutting blade in each of the other references is either formed as a part of or attached to the trigger or pivoted about the pivot point of the trigger.

The present invention provides an improved trimmer assembly which, although actuated by the trigger, is separate from the trigger and being a separate unit can be used to retro-fit existing caulking guns. Another advantage derived from having the tip trimmer assembly as a separate unit is that means are also provided to lock or secure the trimmer assembly in an open position and a closed position so the assembly can be moved to the open position when it is necessary to trim a tip from the cartridge nozzle. The trimmer assembly is automatically moved to the closed position after the tip is trimmed thereby securing the cutting edge internally of the handle until such time that its use is again required to trim another tip off of a cartridge nozzle. The present invention also provides a trimmer assembly having a replaceable blade as a cutting edge and a shaped body portion which extends outward of the handle and prevents the fleshy parts of an operators hand from being pinched between the trigger and the handle.

SUMMARY OF THE INVENTION

The present invention provides a tip trimmer assembly adapted for use between a manually actuated caulking gun handle and trigger assembly having a shaped body with a curved contour along one edge and pivot means adjacent one end of the curved contour. A cutting edge is disposed along a second edge of the shaped body opposite from the curved contour and a detent is carried by the body for selective engagement with predetermined positions on the caulking gun handle.

The shaped body is preferably formed with a recess providing a curved finger engaging portion adjacent the end of the curved contour opposite from the pivot and adapted for moving the shaped body about the pivot to displace the detent from one position to an adjacent position on the caulking gun handle.

In the preferred embodiment, the shaped body is formed of plastic having an aperture adapted to receive a pivot shaft and the cutting edge is provided by a blade removably secured to the body.

The curved contour along one edge of the shaped body is preferably defined by a radius of curvature joining linear segments disposed at an obtuse angle and having a substantially toroidal surface at a mid-portion thereof.

The tip trimmer assembly of the present invention may be pivotally attached internally of a caulking gun handle having a U-shaped cross section at the time of manufacture or it may be readily applied or retro-fit to pre-existing caulking gun handles by drilling one hole to mount a pivot shaft and another hole to permit entry of a cartridge nozzle tip to be trimmed.

The present invention and the advantages provided thereby will be more fully understood with reference to the following detailed description of a preferred embodiment and claims taken in conjunction with the accompanying drawings.

DESCRIPTION OF THE PREFERRED EMBODIMENT

Figures 1, 2:
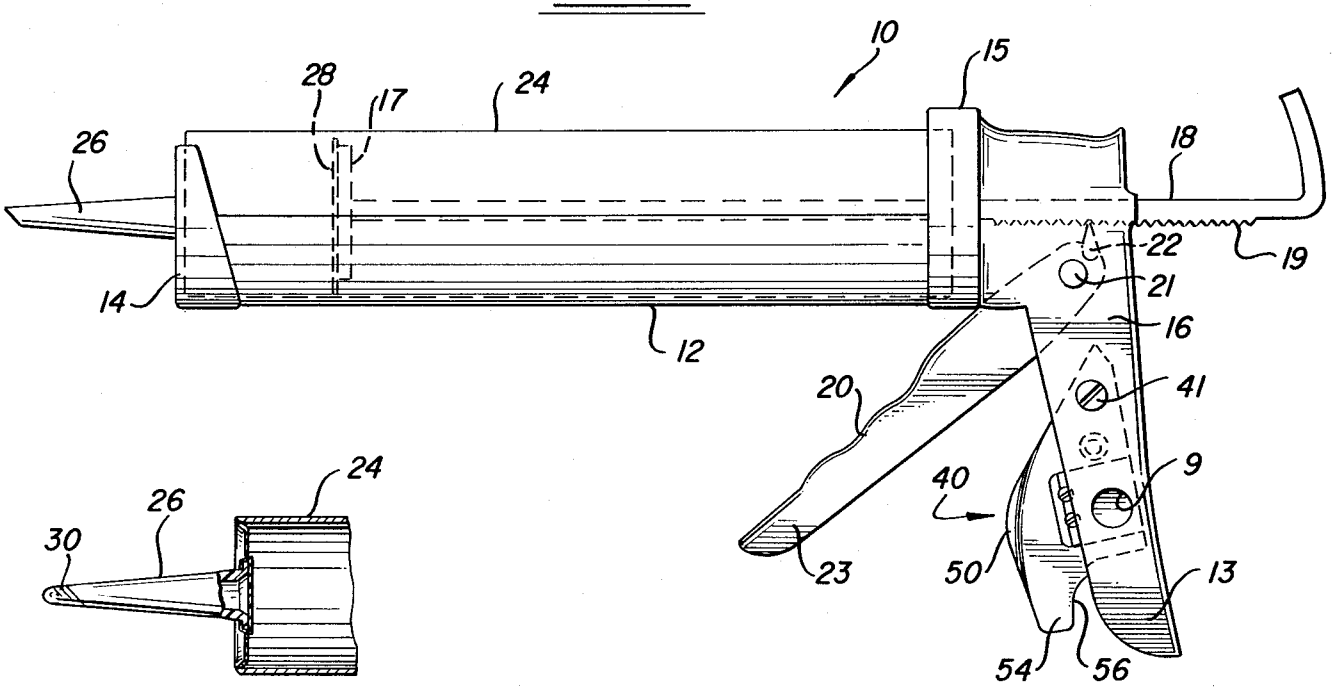
FIG. 1 is a side elevation view of a caulking gun including the tip trimmer assembly of the present invention.
FIG. 2 is a fragmentary, side elevation view, partly in section, showing the nozzle end of a caulking gun cartridge.

With reference to the drawings, wherein like reference numerals designate the same or like parts throughout, there is shown in FIG. 1, a caulking gun generally indicated by reference numeral 10. The caulking gun 10 includes a semi-cylindrical barrel 12 which is partially closed at each end in conventional manner by caps 14 and 15. A pistol grip handle 16 is secured to the end cap 15 both of which are provided with an aperture for slidably receiving a plunger rod 18 having a plurality of rachet 19 teeth formed on one side along substantially the entire length of the rod.

A trigger 20 is pivotally connected to the handle by means for a pivot 21. A detent 22 is pivotally secured at the upper end of the trigger 21 where it is biased by conventional means into contact with the plunger rod 18 between adjacent ones of the rachet teeth 19. The trigger 20 is also biased by conventional means such as a torsion or other spring to its extended position as shown in FIG. 1.

The caulking gun body 12 is designed to receive a removable and replaceable cylindrical cartridge 24 having a nozzle 26 at one end and closed at the other end by a cap 28 inserted for slidable movement internally of the cartridge 24.

The cartridge 24 is a hollow tubular cartridge filled with whatever material is to be applied. The cartridge 24 is closed at one end by a thin impervious material, for example, a metal foil to which the nozzle 26 formed from a relatively soft plastic material, such as polyethylene, polypropylene or equivalents thereof, is supported as shown by FIG. 2. The tip portion 30 of the funnel-like nozzle 27 is closed at the outer end and is formed with a more rapidly reducing interior diameter to permit the operator to select an appropriate diameter for the desired flow rate of material extruded from the caulking gun. The other end of the cartridge 24 is closed by the internally mounted cap 28.

When required for use an operator will normally trim the tip 30 from the cartridge nozzle 26, either straight or on a diagonal to produce a tapered cut such as that shown in FIG. 1, and then puncture the internal, impervious seal with an appropriate length of rigid wire or a tool such as, for example, an ice pick. The operator estimates the length of the tip 30 which is to be trimmed and disposed of to provide an interior opening of such a diameter that will produce the desired flow rate of material. The cartridge 24 is then inserted in the caulking gun body by withdrawing the plunger rod 18, inserting the sealed end of the cartridge into the hollow interior of the end cap 15 and positioning the nozzle 26 in a U-shaped slot provided in the forward end cap 14. The plunger rod 18 is then advanced until a head 17 engages the external surface of the internal cap 28 of cartridge 24.

The caulking gun 10 and cartridge 24 are thus assembled and ready for application of whatever material is provided internally of the cartridge 24 by squeezing the trigger 20 and handle 16 to move the detent 22 in a counter clockwise direction about the pivot 21 and thereby advance the plunger rod 18 to the left as shown by FIG. 1. This squeezing action applies pressure to the end cap 28 and material inside the cartridge 24 which causes material to extrude through the punctured impervious seal and nozzle 26 at the forward end of the cartridge 24. The trigger 20 and handle 16 mechanism is sequentially operated to advance the plunger rod head 17 and cartridge end cap 28 internally of the cartridge 24 until the caulking operation is completed or the supply of material inside the cartridge 24 is exhausted.

The present invention provides an improved tip trimmer assembly for trimming the tip 30 from the nozzle 26 of a cartridge 24.

Figure 3:
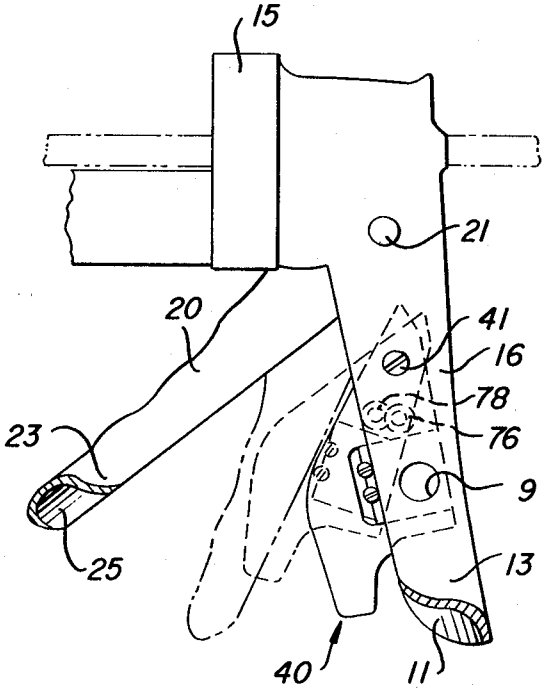
FIG. 3 is a fragmentary view, similar to that of FIG. 1, illustrating the operation of the trigger handle and tip trimmer assembly.

As best shown by FIG. 3, wherein the lower portion of one of the side walls 13 of the handle 16 and the lower portion of one of the side walls 23 of the trigger 20 have been cut away to illustrate the interior surfaces of the opposite side walls 11 and 25 respectively and, to illustrate that the handle 16 and trigger 20 are both formed from a sheet of metal bent or otherwise formed to provide each of these members with a U-shaped cross-section providing each member with a hollow interior portion. The width of the interior void of the handle 16 is greater than the width of the trigger 20 and this facilitates pivotally mounting the trigger 20 internally of the side walls 11 and 13 of the handle 16 by means of a rivet 21 or other suitable pivoting means.

The tip trimmer assembly generally designated by the reference numeral 40 is also pivotally mounted internally of the void space provided by the spaced side walls 11 and 13 of the pistol grip handle 16. An aperture 42 provided through the tip trimmer body 44 is rotatably received on a pivot pin 41 which may comprise a machine screw, rivet or other shaft mounted in axially aligned apertures provided in the side walls 11 and 13 of the pistol grip handle 16.

Figure 6:
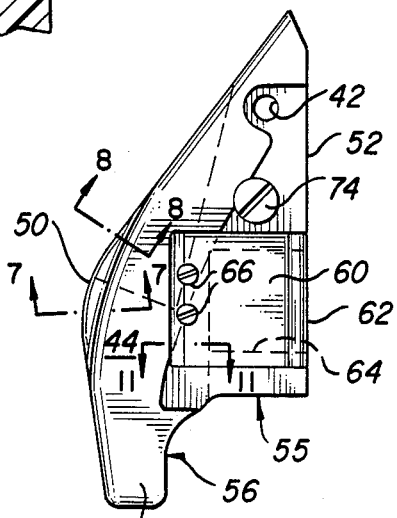
FIG. 6 is a side elevation of the tip trimmer assembly.
Figure 9:
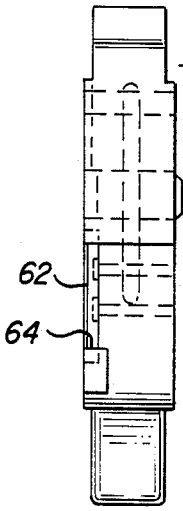
FIG. 9 is a rear elevation view of the trimmer assembly.
Figure 10:
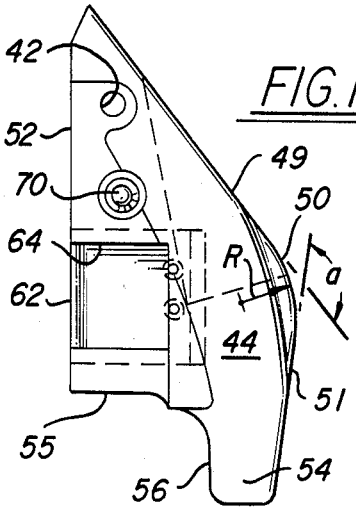
FIG. 10 is a side elevation of the tip trimmer assembly.
Figure 11:
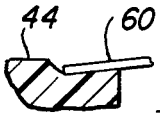
FIG. 11 is a sectional view taken along the line 11—11 of FIG. 6.

The tip trimmer assembly is comprised of a shaped body having a curved contour 50 along one edge and a cutting edge, for example, the cutting edge 62 of a metal blade 60 disposed along a second edge 52 of the shaped body 44. As best shown by FIGS. 6, 9 and 10, a rectangular portion 64 of the shaped body 44 is cut away or otherwise removed behind the blade 60 to facilitate the cutting action. The blade 60 is removably secured to the shaped body 44 by a pair of self-threading metal screws 66. As best shown by FIG. 11, the secured edge of the blade 60 is inset into the tip trimmer body 44 and projects outwardly at an angle of about 10° with the cutting edge 62 flush with the edge 52 of body 44.

The aperture 42 adjacent one end of the curved contour edge 50 provides pivot means for the shaped body 44. A relatively large recess 55 cut away from the second edge 52 provides a projection 54 and together they provide a curved finger engaging portion 56 adjacent the other end of the curved contour edge 50 of the shaped body 44.

The curved contour edge 50 of the shaped body 44 is defined, at least in part, by a radius of curvature "R" joining first and second linear segments 49 and 51 which are disposed at an obtuse angle "a" as shown by FIG. 10. The size of the obtuse angle "a" in the preferred embodiment is about 135° and it is preferred that the angle between the linear segments 49 and 51 be between about 110° and 150° for reasons to be explained here below.

Figure 7:
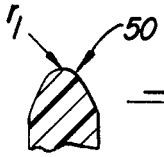
FIG. 7 is a sectional view taken along the line 7—7 of FIG. 6.
Figure 5:
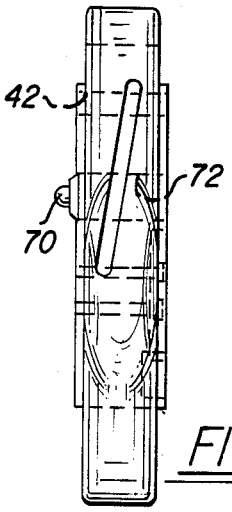
FIG. 5 is a front elevation of the tip trimmer assembly.
Figure 8:
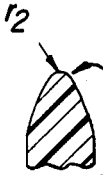
FIG. 8 is a sectional view taken along the line 8—8 of FIG. 6.

As shown by FIGS. 7 and 8, the mid portion of the curved contour edge 50 of the shaped body 44 is also curved by means of a smaller and changing radius of curvature "r1", "r2", etc. in a direction substantially normal to the curvature provided by the radius "R" as shown by FIG. 10. The outer surface of the mid portion of the curved contour edge 50 is thus curved substantially in the form of a toroidal surface except that the radii "r1" and "r2" gradually disappear as the radius "r" blends into the linear segments 49 and 51.

A recess 43 is set at an angle in the forward curved contour edge 50 of the shaped body 44. The recess 43 is provided to receive the rear leg of a torsion spring in those caulking guns which use a torsion spring to bias the trigger to its extended position as shown by FIG. 1. In such instances the torsion spring leg in the recess 43 biases the tip trimmer body 44 toward the handle 16.

A spring biased ball detent means 70 is also provided to the shaped body 44. The ball detent means 70 is mounted internally of an aperture 72 and secured in place by a machine screw 74. The ball detent 70 is provided to selectively engage one of a pair of spherical recesses 76, 78 provided on the interior surface of the side wall 11 of pistol grip handle 16.

The side wall 13 of the pistol grip handle 16 is provided with a relatively large aperture 9 spaced about the same distance from the aperture 42 as the aperture 42 is spaced from the trigger pivot 21.

The location of metal blade 60 on the shaped body 44 and the spherical recesses 76 and 78 provided on the interior surface of the handle side wall 13 are such that when the shaped body 44 pivots as a lever about the pivot pin 41 to engage the ball detent 70 with the aperture 76 the cutting edge 62 of the metal blade 60 is located to the right of the aperture 9 as shown by the solid line representation of the tip trimmer assembly 40 in FIG. 3 thereby occupying a "closed position" with a major surface of the metal blade 60 closing the aperture 9. When the tip trimmer assembly 40 is pivoted clockwise to engage the ball detent 70 in the spherical recess 78 as shown by the dashed line position in FIG. 3 the tip trimmer assembly 40 is in an "open position" with the cutting edge 62 of the metal blade 60 located to the left of the aperture 9.

Figure 4:
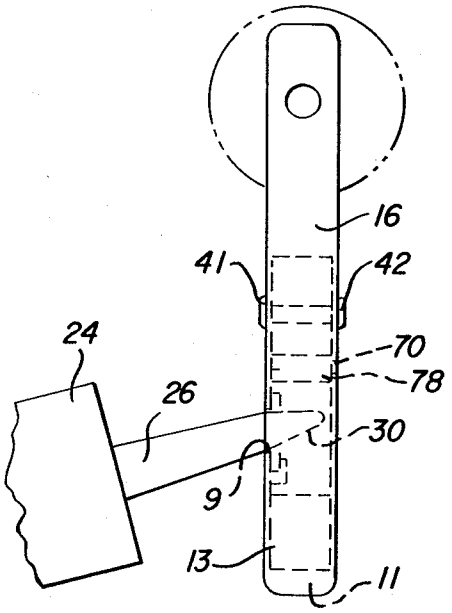
FIG. 4 is a rear view of the handle of the caulking gun of FIG. 1, showing how the nozzle of a caulking gun cartridge may be inserted through an aperture provided in the handle.

In this latter open position, the metal blade 60 is displaced from the aperture 9. The tip 30 of a cartridge nozzle 26 can thus be inserted into the aperture 9 either perpendicularly or at an angle as shown by FIG. 4 and the trigger 20 is squeezed to pivot toward the handle 16. As the trigger 20 approaches the position shown by the phantom lines in FIG. 3 the internal surface of the trigger 20 between the side walls 23 and 25 engages the mid portion of the curved contour edge 50 of the shaped body 44. Continued movement of the trigger 20 causes the tip trimmer assembly 40 to pivot about the pin 41 thereby displacing the ball detent 70 from the recess 78, moving the cutting edge 62 of the blade 60 across the aperture 9 to cut the tip 30 from the nozzle 26 and automatically returning the tip trimmer assembly 40 to the "closed position" with the ball detent 70 seated in the spherical recess 76 until such time that it is necessary to trim another tip from a cartridge nozzle. The angularly inset blade 60 disposes the cutting edge 62 to pass at a slight angle adjacent the interior of aperture 9 and provides a clean cut.

The apparatus is self-cleaning in the tip trimming operation since the trimmed tip 30 falls freely out of the hollow void defined by the U-shaped cross-section of the pistol grip handle 16. When the use of the tip trimmer assembly is required to trim another tip from a cartridge nozzle the operator need only insert a finger between the projection 54 and the interior of the pistol grip handle to engage the portion 56 and pivot the tip trimmer assembly 40 from the closed position as shown in FIG. 1 to the open position where the assembly is ready to perform a tip trimming operation as shown by phantom lines in FIG. 3.

In the preferred embodiment the shaped tip trimmer body 44 is formed of an acetal thermoplastic resin material such as the material marketed by E. I. DuPont de Nemours & Co. under the registered trademark "DELRIN" and the metal blade 60 is provided as a replaceable blade removably secured to the shaped body 44. The shaped tip trimmer body 44 may also be provided either by casting or machining from other materials, for example, a thermoplastic polycarbonate material or a ceramic material and the cutting edge may be formed either by cutting or casting as a sharp edge on the material of the shaped tip trimmer body.

The curved contour edge 50 of the shaped tip trimmer body 44 provides two basic functions. First, during operation of the tip trimmer assembly, when the tip trimmer assembly 40 is moved to the open position the internal surface of the trigger 20 contacts the mid portion of the curved contour edge 50 and pivots the tip trimmer assembly 40 about the pivot 41 to the closed position. The mid portion of the curved contour edge 50 thus provides a rounded bearing surface against which the internal surface of the trigger 20 slides as the trigger 20 moves the tip trimmer assembly 40 about the pivot 41.

Moreover, when the tip trimmer assembly 40 is not being used and is retained in the closed position as shown by FIG. 1, the curved contour edge 50 of the shaped tip trimmer body 44 provides a rounded, smooth surface spaced outwardly from the edges of the side walls 11 and 13 of the pistol grip handle 16 and thus shields the fleshy parts of an operators hand and fingers from being pinched between the rearwardly extending edges of the side walls 23 and 25 of the trigger 20 and the forwardly extending edges of the side walls 11 and 13 of the pistol grip handle. The smooth, curved contour of the edge 50 tends to displace those fleshy parts of the palm and fingers laterally away from the forward edges of the side walls 11 and 13 of the handle 16 before the trigger 20 closely approaches the pistol grip handle 16.

The tip trimmer assembly of the present invention thus provides several safety features. The tip trimmer assembly is separate from the trigger and can be locked in a closed position with the cutting edge secured internally of the pistol grip handle when its use is not required to trim a tip from the cartridge nozzle. Secured in that position the forward contoured edge of the tip trimmer body also helps avoid pinching of the fleshy parts of the operators palm and fingers between the trigger and pistol grip assembly.

An additional advantage is that the tip trimmer assembly of the present invention can be readily retrofit to caulking guns by simply drilling axially aligned holes through the side walls of the pistol grip handle to secure a pivot shaft and drilling a larger diameter hole to serve as a nozzle receiving aperture.

Although a single embodiment of the invention has been disclosed, the present invention is not to be construed as limited to the particular form disclosed herein since the foregoing description is to be regarded as illustrative rather than restrictive and it should be understood that modifications and variations in the details of construction may be made without departing from the spirit and the scope of the invention as defined by the claims appended hereto.

What is claimed is:

1. A caulking tube tip trimmer assembly adapted for use between a manually actuated caulking gun handle and trigger assembly comprising a body having a curved contour along one edge, pivot means adjacent one end of said curved contour, a cutting edge disposed along a second edge of said body and detent means carried by said body for selective engagement with one of a plurality of receiving means on a caulking gun handle.

2. The tip trimmer assembly defined by claim 1 wherein said body is formed with a recess providing a curved finger engaging portion adjacent the other end of said curved contour and adapted for moving, said body about said pivot means to displace said detent means from one of said receiving means to an adjacent receiving means on said caulking gun handle.

3. The tip trimmer assembly defined by claim 1 wherein said pivot means is an aperture adapted to receive a pivot shaft.

4. The tip trimmer assembly defined by claim 1 wherein said cutting edge is provided on a blade removably secured to said body.

5. The tip trimmer assembly defined by claim 1 wherein said body is formed of plastic.

6. The tip trimmer assembly defined by claim 1 wherein a mid-portion of the edge surface of said curved contour along one edge of said shaped body is a substantially toroidal surface.

7. The tip trimmer assembly defined by claim 1 wherein said curved contour along one edge of said body is defined by a radius of curvature joining first and second linear segments of said one edge.

8. The tip trimmer assembly defined by claim 7 wherein said first and second linear segments of aid one edge are disposed at an obtuse angle.

9. The tip trimmer assembly defined by claim 1 wherein said cutting edge is provided by a metal blade secured to said body and said metal blade is inset in said body at an angle relative to a major surface of said body.

10. A caulking gun comprising a barrel having a reciprocal plunger and a handle having a U-shaped cross-section secured to the barrel, an aperture through one side of said handle, first and second pivots carried by said handle, a trigger having a U-shaped cross-section pivotally mounted on said first pivot, means interposed between the trigger and the plunger to advance the plunger each time the trigger is actuated, a lever pivotally mounted on said second pivot, said lever comprising a body having a cutting edge disposed for movement traversing said aperture internally of said handle, said body having a contoured edge opposite said cutting edge, means carried by said and cooperative with means on said handle for securing said lever in a first position closing said aperture with said cutting edge on one side of said aperture and a second position with said aperture open for receipt of a tip of a nozzle of a caulking tube, said body being of such a width that a portion of said contoured edge protrudes from said handle in each of said first and second positions, whereby when said lever is releasibly secured in said second position and a tip of a caulking tube nozzle is inserted in said aperture said protruding portion of said contoured edge of said body will be contacted by said trigger and moved by said trigger to said first position with said cutting edge traversing said aperture and cutting said tip from said nozzle upon actuation of said trigger.

11. The caulking gum defined by claim 10 wherein said cutting edge is provided by a metal blade secured to said body and said metal blade is inset in said body and disposed at an angle to pass closely adjacent to an interior surface of said handle as said cutting edge traverses said aperture.

* * * * *